United States Patent [19]

Koshizuka et al.

[11] Patent Number: 4,882,218

[45] Date of Patent: Nov. 21, 1989

[54] THERMAL TRANSFER RECORDING MEDIUM

[75] Inventors: Kunihiro Koshizuka; Takao Abe, both of Hino, Japan

[73] Assignee: Konica Corporation, Tokyo, Japan

[21] Appl. No.: 252,879

[22] Filed: Oct. 3, 1988

[30] Foreign Application Priority Data

Oct. 13, 1987 [JP] Japan ..... 62-257885

[51] Int. Cl.[4] ..... B41M 5/26

[52] U.S. Cl. ..... 428/216; 428/195; 428/204; 428/207; 428/484; 428/488.1; 428/488.4; 428/515; 428/520; 428/913; 428/914; 428/411.1

[58] Field of Search ..... 428/216, 195, 207, 209, 428/211, 484, 488.1, 488.4, 913, 914, 204, 515, 520, 411.1

[56] References Cited

U.S. PATENT DOCUMENTS 4,623,580 11/1986 Koshizuka et al. ..... 428/488.4
4,732,815 3/1988 Mizobuchi et al. ..... 428/488.4
4,783,360 11/1988 Katayama et al. ..... 428/484

*Primary Examiner*—Ellis P. Robinson
*Assistant Examiner*—P. R. Schwartz
*Attorney, Agent, or Firm*—Frishauf, Holtz, Goodman & Woodward

[57] ABSTRACT

A thermal transfer recording medium having two heat softening layers is disclosed. The heat softening layers each contain a polyoxyethylated compound. The recording medium is improved not only in a high speed printing properties but also in a quality of characters printed on a transferee medium having a rough surface.

23 Claims; No Drawings

THERMAL TRANSFER RECORDING MEDIUM

FIELD OF THE INVENTION

The present invention relates to a thermal transfer recording medium of improved high speed print quality, and more particularly, to a thermal transfer recording medium capable of producing high quality prints at a high speed on a transferee medium of poor surface smoothness.

BACKGROUND OF THE INVENTION

A thermal transfer recording medium having a support and a heat softening layer coated on the support is widely used for printing (transferring) with a thermal printer such as a word processor. However, the conventional transferring technique using a thermal printer has fundamental problems such as print quality seriously influenced by the smoothness of a transferee medium (ex. a transfer sheet); and a printing speed slower than that of other transferring techniques.

For improving print quality with a transferee medium of poor surface smoothness, there has been proposed techniques of multi-layered heat softening layer; and techniques of improving the transferability of the heat softening layer by incorporating various additives. For example, Japanese Patent Publication Open to Public Inspection (hereinafter referred to as Japanese Patent O.P.I. Publication) No. 235189/1986 discloses a thermal transfer recording medium having an intermediate layer containing a supercooling substance (ex. polyethylene glycol), between a heat softening layer (heat-fusible ink layer) and a support. Since the intermediate layer containing a supercooling substance can maintain the heat softening layer in a fused state for a relatively long time, it can afford high print quality even with a transferee medium of poor surface smoothness so fat as the heat softening layer (heat-fusible ink layer) can remain in a fused state.

However, it was learned that either of the above-mentioned techniques for improving the print quality with a transferee medium of poor surface smoothness serves insufficiently when such a technique is applied to a high speed printer developed in compliance with current consumer's demand, i.e. higher printing speed. On a high speed printer, the heat softening layer is not firmly transferred onto a transferee medium because the heat softening layer remains in the fused state for a short duration, thereby a heat softening layer, even that attains good print quality with a transferee medium of poor surface smoothness at a normal recording speed, affords significantly deteriorated print quality at a higher recording speed.

As a result, there is a growing demand for developing a thermal transfer recording medium capable of recording high quality prints on a transferee medium of poor surface smoothness by using a high speed printer.

SUMMARY OF THE INVENTION

Accordingly, it is an object of the present invention to provide a thermal transfer recording medium capable of high print quality at a higher printing speed.

Another object of the present invention is to provide a thermal transfer recording medium capable of recording high quality characters at a higher speed on a transferee medium of poor surface smoothness.

The above objects are achieved by a thermal transfer recording medium comprising a support having thereon a first heat softening layer, and a second heat softening layer in this order, wherein the first and second heat softening layers individually contains a polyoxyethylated compound and at least one of said layers contains a colorant.

DETAILED DESCRIPTION OF THE INVENTION

A thermal transfer recording medium in accordance with the present invention comprises a support, and at least two heat softening layers, i.e. a first heat softening layer, and a second heat softening layer in this order. The heat softening layers can be formed on the support with interposition of additional layers as far as the additional layers do not adversely affect the properties of the heat softening layers. For example, the first heat softening layer can be formed on the support via another layer such as a stripping layer; there may be an intermediate layer beneath the second heat softening layer. The second heat softening layer is preferable to be the outermost layer.

Support

A preferred support for a thermal transfer recording medium of the present invention is a high heat resistant support of good dimensional stability and good smoothness.

The examples of a material for forming the support include paper such as normal paper, condenser paper, and laminated or coated paper; a resin film made such as of polyethylene, polyethylene terephthalate, polystyrene, polypropylene and polyimide, a combination of paper and resin film; and a metal sheet of aluminum foil, etc. Specifically as the support of the present invention, it is preferable to select one from the resin films, a combination of paper and resin film, or the metal sheet each having a smooth surface and allowing the first heat softening layer to be stripped from the support. The especially preferable is a resin film made of a material having good thermal conductivity and heat-resistance, such as polyethylene terephthalate.

The thickness of the support is usually not more than 60 μm in order to obtain good heat transmittance. The particularly preferred thickness is within a range of 1.5 to 15 μm. To control adhesion of the support to a heat softening layer and like, the surface of the support may be subjected to surface treatment such as corona discharge process, glow discharge process, and other electrical impact technique; or to flame treatment, ultraviolet irradiation, oxidation, and saponification; or subbing process.

The support can have a backing layer on the other surface thereof.

Heat softening layer

A thermal transfer recording medium of the invention comprises a first heat softening, and a second heat softening layer. The thermal transfer recording medium of the invention contains a colorant in both the first heat softening layer and the second heat softening layer, or in either of both layers.

The examples of the colorant that can be incorporated into the thermal transfer recording medium of the invention include conventional inorganic or organic pigments, and dyes.

The examples of the inorganic pigment include titanium dioxide, carbon black, zinc oxide, prussian blue, cadmium sulfide, and iron oxide; chromates of lead, zinc, barium, and calcium. The examples of the organic pigment include azo, thioindigo, anthraquinone, anthoanthrone, and triphenonedioxazine, vat dye pigments, and phthalocyanine pigments, metal (ex. copper) phthalocyanine and its derivatives, and quinacridon pigment.

The examples of the organic dye include acid dyes, direct dyes, disperse dyes, oil suluble dyes, and metal complex oil soluble dyes.

The content of the colorant per total amount of the constituents in the heat softening layer is usually within a range of 5 to 30 wt. %. When both the first and the second heat softening layers contain a colorant, the total content of the colorant in both layers must be within the above range with relative to the total amount of the constituents in the layers. The content of colorant in each layer can be arbitrarily selected from the above range.

First heat softening layer

The first heat softening layer generally contains a heat-fusible substance and a thermoplastic resin. This layer in the thermal transfer recording medium of the invention contains a polyoxyethylated compound.

The typical examples of the heat-fusible substance incorporated into the thermal transfer recording medium of the invention are as follows:

Vegetable waxes such as carnauba wax, Japan wax, auriculae wax, and esparto wax;

animal waxes such as beeswax, insect wax, shellac wax, and spermaceti wax;

petroleum waxes such as paraffin wax, microcrystalline wax, polyethylene wax, ester wax, and acid wax;

mineral waxes such as montan wax, ozokerite, and cerecine;

higher fatty acids such as palmitic acid, stearic acid, margaric acid, and behenic acid;

higher alcohols such as palmityl alcohol, stearyl alcohol, behenyl alcohol, marganyl alcohol, myricyl alcohol, and eicosanol;

higher fatty acid esters such as cetyl palmitate, myricyl palmitate, cetyl stearate, and myricyl stearate;

amides such as acetamide, propiomic acid amide, palmitic acid amide, stearic acid amide and amide wax; and higher amines such as stearly amine, behenyl amine, and palmityl amine; these examples can be used singly or in combination.

The examples of the thermoplastic resin used in the invention are as follows:

Resins such as ethylene copolymers, polyadide resins, polyester resins, polyurethane resins, polyolefin resins, acrylic resins, vinyl chloride resins, cellulose resins, and ionomer resins;

unmodified or modified rosin such as rosin resins, hydrogenated rosin resins, rosin maleic acid resins, and rosin phenol resins;

terpene resins;

petroleum resins (melting point, 50° to 150° C.);

elastomers such as diene copolymers, natural rubber, styrene-butadiene rubber, isoprene rubber, and chloroprene rubber; and high molecular compounds having a melting point of 50 to 150° C., such as phenol resins, cyclopentadiene resins, and aromatic hydrocarbon resins.

When using a thermoplastic resin, those especially advantageous among the above examples are acrylic resins, diene copolymers, and ethylene copolymers. A liquid tackifier used in conjunction with an ethylene copolymer, such as ethylene-vinyl acetate copolymer, provides a thermal transfer recording medium that excels especially in high speed print quality.

The preferred thermoplastic resins are hereunder described.

The examples of the acrylic resin include an acrylic resin obtained by polymerizing a monobasic carboxylic acid such as (meth) acrylic acid or ester thereof with at least one compound being capable of copolymerizing with the former.

The examples of the carboxylic acid or ester thereof, each useful for this purpose, include (meth) acrylic acid, methyl (meth) acrylate, ethyl (meth) acrylate, isopropyl (meth) acrylate, butyl (meth) acrylate, isobutyl (meth) acrylate, amyl (meth) acrylate, hexyl (meth) acrylate, octyl (meth) acrylate, 2-ethylhexyl (meth) acrylate acid, decyl (meth) acrylate, dodecyl (meth) acrylate, and hydroxyethyl (meth) acrylate. The examples of the above-mentioned copolymerizable compound include vinyl acetate, vinyl chloride, vinilidene chloride, maleic acid anhydride, fumaric acid anhydride, styrene, 2-methylstyrene, chlorostyrene, acrylonitrile, vinyltoluene, N-methylol (meth) acrylamide, N-botoxymethy (meth) acrylamide, vinylpyridine, and N-vinylpyrrolidone; these examples can be used singly or in combination.

The examples of the diene copolymer include butadiene-styrene copolymers, butadiene-styrene-vinylpyridine compolymers, butadiene-acrylonitrile copolymers, chloroprene-styrene copolymers, and chloroprene-acrylonitrile copolymers.

The examples of the ethylene copolymer include ethylene-vinyl acetate copolymers, ethylene-ethyl acrylate copolymers, ethylene-methyl methacrylate copolymers, ethylene-isobutyl acrylate copolymers, ethylene-acrylic acid copolymers, ethylene-vinyl alcohol copolymers, ethylene-vinyl chloride copolymers, and ethylene-acrylic acid metal-salt copolymers.

The first heat softening layer of the thermal transfer recording medium of the invention contains a polyoxyethylated compound. The polyoxyethylated compound in the first layer improves the transferability of the first layer onto a transferee medium of poor surface smoothness by supercooling the first heat softening layer.

The polyoxyethylated compound used in embodying the invention is a compound having in the molecular structure thereof a polyoxyethylene chain represented by the following general formula:

$$-(-CH_2CH_2O-)_n-$$

wherein n denotes an integer of not less than 2.

A preferred compound having the above polyoxyethylene chain is a substance being solid at a room temperature and has a melting point within a range of 30° to 120° C., and a particularly preferred similar compound has a melting point within a range of 40° to 100° C.

The examples of the polyoxyethylated compound useful in the present invention include polyethylene glycol and polyethylene glycol derivatives. Either of the polyethylene glycol and polyethylene glycol derivative can be used for the recording medium of the present invention, and the polyethylene glycol derivatives tend to provide better high speed print quality with a transferee medium of poor surface smoothness.

The polyethylene glycol derivatives possibly used in the invention can be generally prepared by allowing one or two alcoholic hydroxyl groups of polyethylene glycol to react with a compound selected from a variety of organic compounds by a conventional method. The so-obtained polyethylene glycol derivatives contain, depending on the types of organic compounds used, corresponding one of ether linkage, ester linkage, linkage through sulfur or nitrogen atom, urethane linkage and other types of linkage. The preferred polyethylene glycol derivatives of the invention are those having either ether or ester linkage.

The preferred polyoxyethylated compounds are such that the molecular weight of the polyoxyethylene chain in the molecular structure thereof is within a range of 200 to 20000.

The typical examples of the polyoxyethylated compound used in the present invention are as follows:

(1) Polyethylene glycol

Polyethylene glycols and diethylene glycols having repeating structural units represented by:

$$-(-CH_2CH_2O-)-$$

wherein the average molecular weight of the structural units portion is within a range of 100 to 20000 (typically, 20,000, 12,000, 9000, 1000, 400 or 100).

(2) Mono- of di-ester derivative of polyethylene glycol

If the polyethylene glycol is derived from a fatty acid, the fatty acid preferably has 10 to 50 carbon atoms, and, in particular, 10 to 19 carbon at atoms.

The examples of the fatty acid ester of polyethylene glycol include mono- or di-ester derivatives of such as capric acid, undecane acid, lauric acid, tridecane acid, myristic acid, pentadecane acid, palmitic acid, margaric acid, stearic acid, nonadecane acid, arachidic acid, heneicosane acid, behenic acid, tricosane acid, and lignoceric acid. Among these examples, those particularly preferred are the mono- or di-ester derivatives of nonadecane acid, arachidic acid, heneicosane acid, behenic acid, tricosane acid, and lignoceric acid.

The examples of the above-mentioned mono- or di-ester derivatives of the polyethylene glycol include straight-chained mono-ene acids, diene acids, tri-ene acids, and tetra-ene acids, synthetic fatty acids, tertiary fatty acids, branched fatty acids, dimer acids, di-basic acids, multi-basic acids, oxycarboxylic acids, fatty acid chlorides, fatty acid anhydrides, and polycarboxylic acids; and other compound having in the molecular structure thereof one or more carboxyl groups. The two esters in a diester derivatives may be either identical or different with each other.

The typical examples of the polyethylene glycol derivative include:

| | |
|---|---|
| Polyethylene glycol monobehenate | (PEG, 4000) |
| Polyethylene glycol distearate | (PEG, 6000) |
| Polyethylene glycol monopalmitate | (PEG, 600) |
| Polyethylene glycol dibehenate | (PEG, 14000) |
| Polyethylene glycol laurinate | (PEG, 100) |

The numerals in the parentheses indicate the average molecular weight of polyethylene glycol (PEG) in the $-(CH_2CH_2O-)_n-$ portion (PEG portion) (hereinafter applicable).

(3) Monoalkyl, arylalkyl or alkylaryl-ether derivative of polyoxyethylene glycol (compound whose one —OH group being replaced with ether)

This type of ether preferably has not less than 6 carbon atoms, and the particularly preferred examples are polyethylene glycol ethers of alkyl or alkylaryl having 18 to 50 carbon atoms.

In these polyethylene glycol ethers, the alkyl group may be either straight-chained or branched, and can substituted by halogen atoms.

The useful polyethylene glycol ethers include those of unsaturated hydrocarbon, synthetic alcohol, oxycarboxylic acid, and of nitrogen-sulfur containing compound.

The typical examples of such polyethylene glycol ethers include:

| | |
|---|---|
| Polyethylene glycol mono-P—nonylphenyl ether | (PEG, 900) |
| Polyethylene glycol monobehenyl ether | (PEG, 6000) |
| Polyethylene glycol monocetyl ether | (PEG, 200) |
| Polyethylene glycol monooleyl ether | (PEG, 4000) |

(4) Ether- or ester derivative of the above-mentioned monoether derivative (3)

This type of derivative is obtained by replacing, with either or ester, the other —OH group remaining on the above defined (3) monoalkyl-ether derivative or arylalkylaryl ether derivative of polyethylene glycol ether.

In this case, replacement with ester is similar to that of the above-mentioned case (2), while replacement with ether is similar to that of the above-mentioned case (3).

The typical examples of the ether- or ester-derivative are as follows:

| | |
|---|---|
| Monobehenate of polyethylene glycol mono-P—nonylphynyl ether | (PEG, 800) |
| Monostearate of polyethylene glycol monobehenyl ether | (PEG, 9000) |
| Polyethylene glycol dibehenyl ether | (PEG, 6000) |
| Polyethylene glycol monooleyl ether monobehenyl ether | (PEG, 4000) |

(5) Polyoxyethylene ether derivative of polyvalent alcohol

A polyvalent alcohol is a compound having two or more alcoholic —OH groups in the molecular structure thereof, and the examples of which include glycerine, polyglycerine, propylene glycol, pentaerythritol, sorbitan (1,5-sorbitan, 1,4- or 3,6-sorbitan, or isosorbide), mannitol; and polyvinyl alcohols (povals) whose molecular weight not greater than 800. And the polyoxyethylene ether derivative is a compound obtained by replacing one, or two or more intramolecular alcoholic —OH groups of any of the above mentioned polyvalent alcohols with ester and/or ether according to the above case (2) and/or (3).

The polyoxyethylene ether derivative has one or more polyoxyethylene chains in the molecular structure thereof, wherein one end of the polyoxyethylene chain is preferably replaced with ester and/or ether according to the above case (2) and/or (3).

Such a polyoxyethylene ether derivative may have a structure comprising two or more polyvalent alcohol bonded together; or may have a crosslinking structure comprising a polyoxyethylene chain.

The typical examples of the polyoxyethylene ether derivative are as follows:

Polyoxyethylene monostearate of glycerine
Di (polyoxyethylene monostearate) of glycerine
Polyoxyethylene monobehenyl ether of sorbitan monobehenate
Polyoxyethylene oleate of butyl alcohol
Block copolymer of polypropylene glycol and polyoxyethylene glycol
Polyoxyethylene ether of polyglycerine polystearate
Polyoxyethylene ether of behenate of pentaerythritol distearly ether
Polyoxyethylene ether of sorbitan ester
Polyoxyethylene ether of pentaerythritol
Polyoxyethylene ether of polyglycerine ester
Polyoxyethylene ether of butyl alcohol ester
Polyoxyethylene ether of mannitol ester (6) Polyoxyethylated compound of a molecule containing sulfur atom or nitrogen atom The typical examples include alkylthiopolyoxyethylene ether, polyoxyethylene fatty acid amide, and polyoxyethylenealkylamine.

(7) Polyoxyethylene derivative of polymer or copolymer

The typical examples include alkylarylformaldehyde condensed polyoxyethylene ether, polyoxyethylene ether ester of a copolymer, and polyoxyethylene ether derivative of $\alpha$-olefin-maleic acid anhydride copolymer.

(8) Block polymer of synthetic polymer such as polyester and polyurethane; and polyoxyethylene (9) Anionic compound The typical examples include a polyoxyethylene containing anionic active agent such as carboxylate salt of polyoxyethylene alkyl (aryl) ether, sulfate salt of polyoxyethylene fatty acid ester, sulfate salt of polyoxyethylene alkyl (aryl) ether, phosphate salt of polyoxyethylene alkyl (aryl) ether, phosphate salt of polyoxyethylene alkyl (aryl) amide, carboxylate salt of polyoxyethylene fatty acid ester.

(10) Cationic compound

The typical examples include a polyoxyethylene containing cationic active agent and amphoteric active agent such as alkyl (aryl) polyoxyethylene ether ammonium salt, and polyoxyethylene hydroxyammonium salt.

Among these polyethylene glycol derivatives in (1) through (10), those preferred are polyethylene glycol derivatives exemplified in (2) through (10), and the particularly preferred are polytehylene glycol monobehenyl ether and polyethylene glycol distearly ester. The first heat softening layer is a layer containing the heat-fusible substance, thermoplastic resin, and polyoxyethylated compound each described above, and, if necessary, a colorant. The total amount of a heat-fusible substance and a thermoplastic resin contained in this layer is usually not less than 55 wt. % of the total weight of non-volatile constituents of the layer. The content of the heat-fusible substance is preferably more than that of the thermoplastic resin in the first heat softening layer. By this arrangement, the first heat softening layer is more readily stripped from the support in the course of transferring. Additionally, the blending ratio by weight of the heat-fusible substance and the thermoplastic resin in the first heat softening layer is preferably within a range of 99:1 to 55:45, in particular, 90:10 to 60:40. The blending ratio within the above range allows the supercooling operation of a polyoxyethylated compound to be fully demonstrated.

The content of the polyoxyethylated compound in the first heat softening layer is usually not more than 15 wt. % of the weight of the total non-volatile constituents of this layer. A still more content does not further enhance the supercooling in the first heat softening layer, and, the transferred characters (transferred member) may have high tackiness. According to the invention, a specific range of the content of the polyoxyethylated a compound, i.e. 1 to 10 wt. %, can allow the first heat softening layer to be more readily stripped off the support in the course of a high speed print operation.

Second heat softening layer

The thermal transfer recording medium of the invention comprises a second heat softening layer, in addition to the aforesaid first heat softening layer. The second heat softening layer generally contains a colorant, heat-fusible substance and thermoplastic resin. Meanwhile, the second heat softening layer on the thermal transfer recording medium of the invention further contains a polyoxyethylated compound.

The polyoxyethylated compound in the first heat softening layer serves, as mentioned previously, as a supercooling substance. The inventor, however, learned that when incorporated into the second heat softening layer, the polyoxyethylated compound in the second heat softening layer not only serves as a supercooling substance, but also allows the constituents in the second heat softening layer to deeply penetrate into the transferee medium. More specifically, the high speed printing operation requires that second heat softening layer should quickly attain a fused state, that the fused state should be maintained for a relatively long time, and that second heat softening layer in a fused state should quickly penetrate deep into the transferee medium to firmly deposit a colorant and the like thereon. When the transferee medium has a surface of poorer smoothness, the distance between the "summits" and the "bottoms of valleys" are greater, and, in a high speed transferring operation, the constituents of the heat fusible composition in the fused state fails to reaches the "bottoms", thereby the colorant deposits around the summits alone to form characters. Consequently, the resulting high speed print quality with a transferee medium of surface smoothness is significantly poorer. In contrast, the thermal transfer recording medium of the invention contains a polyoxyethylated compound in its second heat softening layer too, thereby a portion of the second heat softening layer in the fused state penetrates deep into the "valleys" on the transferee medium, and the constituents such as a colorant in the second heat softening layer are firmly fixed. In this course, the polyoxyethylated compound in the first heat softening layer cooperates with that in the second heat softening layers so as to produce a high quality print characters of a smaller void ratio.

The second heat softening layer of the thermal transfer recording medium of the invention can contain any of the same thermoplastic resins, heat-fusible substances and polyoxyethylated compounds as examplified for the first heat softening layer. As the polyoxyethylene compound, like in the first heat softening layer, polyethylene glycol derivatives show better high speed print quality with a transferee medium of poor surface smoothness. The thermoplastic resin, heat-fusible substance and polyoxyethylated compound incorporated into the first heat softening layer may be either identical with or different from those of the second heat softening layer.

The second heat softening layer is a layer that fixes a colorant onto the transferee medium, therefore, the content of the thermoplastic resin in the second layer is preferably greater than that of the heat-fusible substance. Furthermore, the blending weight ratio of the heat-fusible substance and the thermoplastic resin in the second hear softening layer is preferably within a range of 10:90 to 45:55, in particular, a range of 15:85 to 40:60. By setting the weight ratio in the above range, the colorant shows good fixing characteristics. The content of the total amount of the heat-fusible substance and the thermoplastic resin per total weight of constituents in the second heat softening layer is usually not less than 50 wt. %.

The content of the polyoxyethylated compound in the second heat softening layer is usually not more than 25 wt. % of the weight of the total non-volatile constituents of this layer. When the content of the similar compound is greater than the above level, adhesion may occur between the upper surface of the wound-up thermal transfer recording medium and the back face of the support, and a take out torque required will be greater, possibly resulting in lowering high speed print quality. According to the present invention, a specific range of content of the polyoxyethylated compound, i.e. the range of 5 to 20 wt. %, enables the similar compound to satisfactorily serve as a supercooling substance in the second heat softening layer, and to allow the constituents of this layer to penetrate deep into a transferee medium of poor smoothness, thereby high quality print characters are formed.

From the viewpoint of operation of the polyoxyethylated compound in both first and second heat softening layers, the content of the polyoxyethylated compound in the second heat softening layer is preferably greater than that in the first heat softening layer. The polyoxyethylated compound in the first heat softening layer serves merely as a supercooling substance for the first layer. Meanwhile, the polyoxyethylated compound in the second heat softening layer not only serves as a supercooling substance but also to allows the constituents in this layer to penetrate deep into the transferee medium. Accordingly, to ensure the above-mentioned operations of the polyoxyethylated compound in each of the first and second heat softening layers, the contents of the polyoxyethylated compounds in the respective layers are preferably selected to be within the above-mentioned ranges.

Preparation method for each layer

The thermal transfer recording medium of the present invention can be prepared using a conventional coating device according to any of the following coating processes:

Solvent coating process where the constituents of the first or second heat softening layer are dissolved or dispersed in an organic solvent to prepare a coating solution that is subjected to the coating process;

hot-melt coating process where the constituents of the first or second heat softening layer are heated so that at least part of them takes the fused state, and the fused material is subjected to the coating process; and water based coating process where the constituents of the first or second heat softening layers are dispersed in water to prepare an aqueous coating solution, and the coating solution is subjected to the coating process.

The advantageous method according to the invention is the water based coating process. In this process, an aqueous emulsion of the constituents of the first heat softening layer and an aqueous emulsion of the constituents of the second heat softening layer are individually prepared, and the aqueous emulsion for the first heat softening layer is first applied to and dried on the support, and then, to the first heat softening layer is applied and dried thereon the aqueous emulsion for the second heat softening layer.

Drying of the first and second heat softening layers is preferably performed respectively at a temperature that does not disturb the configurations of the particles constituting the so-applied aqueous emulsions for the respective layers. In other words, immediately after coating, the particles previously constituting aqueous emulsion maintain their original state in the first and second heat softening layers that have been formed on the support by the water base coating process. It is presumable that from a microscopic viewpoint, each layer is formed as an agglomerate of the particles that are constituents of an aqueous emulsion, as a result of drying each layer at a temperature lower than a fusing (softening) point of the constituents of the corresponding aqueous emulsion. A portion of the heat softening layer, in which the particles maintain original configuration, is readily severed and stripped at the boundary between particles in the course of a thermal transferring operation, and is transferred onto the transferee medium, thereby the heat softening layers are endowed with advantages such as transfer members (printed characters) of extremely sharp edges.

Each of the aqueous emulsions for the first and second heat softening layers is usually applied so that the resultant dry thickness is within the range of 0.5 to 8.0 μm (preferably 1 to 4 μm). The coating operation is preferably performed so that the thickness of the first heat softening layer is equal to or greater than that of the second heat softening layer. A thickness of the first heat softening layer 1 to 2 times (preferably, 1.1 to 1.8 times) as large as that of the second heat softening layer can improve high speed print quality with a transferee medium of poor smoothness.

When the first and second heat softening layers are formed by coating with aqueous emulsions, a fluorinated surfactant is preferably incorporated into the respective emulsions. Adding a fluorinated surfactant reduces the surface tension of aqueous emulsions, and permits the aqueous emulsions to be uniformly applied. Adding a fluorinated surfactant to an aqueous emulsion of constituents for the second heat softening layer is especially advantageous in that the addition positively prevents blocking phenomenon where the second heat softening layer and the back face of the support adheres with each other on a thermal transfer recording medium that is in a wound-up state for storage thereby the torque required for taking out the medium is smaller, hence improve high speed printing performance. The fluorinated surfactant useful for this purpose are, for example, those described in Japanese Patent O.P.I. Publication No. 196182/1987. The amount of fluorinated surfactant added is usually within the range of 0.05 to 3 wt. % of the weight of total non-volatile constituents in the second (or first) heat softening layer. The aqueous emulsion may contain an ordinary surfactant in addition to a fluorinated surfactant.

The aqueous emulsions can incorporate additives commonly added to a heat softening layer. Such additives include a thickener such as sodium polyacrylate, and an agent that improves the properties of the heat softening layer, such as colloidal silica.

Application

The thermal transfer recording medium of the present invention can be used in the known form such as a strip or sheet. The recording medium of the present invention can be satisfactorily used not only as a thermal transfer recording medium for high speed transferring operation, but also as a thermal transfer recording medium that is intended for a high speed transferring operation with a transferee medium of poor smoothness.

EFFECT OF THE INVENTION

The polyoxyethylated compound in the first heat softening layer serves as a supercooling substance, while the polyoxyethylated compound in the second heat softening layer serves not only as a supercooling substance but also as a carrier substance that transports the constituents of this layer such as a colorant. Accordingly, the thermal transfer recording medium of the invention is capable of significantly high print quality with a transferee medium of poor surface smoothness at a high speed, and such high quality at a high speed has not been achieved by a conventional thermal transfer recording medium.

The print quality of the present recording medium can be further improved by adjusting the blending rate of the heat-fusible substance and the thermoplastic resin in the first and second heat softening layers, and by adjusting the content of polyoxyethylated compounds in the first and second heat softening layers.

EXAMPLES

The term "part" in the following examples of the invention and in comparative examples means "part by weight".

EXAMPLE 1

Onto a 3.5 μm thick polyethylene terephthalate film was applied aqueous emulsion (I) specified below for forming the first heat softening layer, by water based coating process so that the dry thickness was 2.0 μm, thus the first heat softening layer was formed.

Aqueous emulsion (I) for first heat softening layer

| (solid converted amount, hereunder applicable) | |
|---|---|
| Aqueous paraffin wax emulsion | 85 parts |
| Aqueous ethylene-vinyl acetate copolymer emulsion | 5 parts |
| Aqueous polyethylene glycol (5) mono behenyl ether emulsion | 10 parts |

Next, onto the first heat softening layer was applied aqueous emulsion (I), whose composition specified below, for forming the second heat softening layer so that the dry thickness was 1.5 μm, so as to form the second heat softening layer, thus a thermal transfer recording medium of the invention was obtained.

Aqueous emulsion (I) for second heat softening layer

| | |
|---|---|
| Aqueous acrylic emulsion | 45 parts |
| Aqueous paraffin wax emulsion | 24 parts |
| Aqueous polyethylene glycol (5) mono behenyl ether emulsion | 5 parts |
| Aqueous carbon black dispersion | 25 parts |
| FT-248 (fluorinated surfactant, make of B.A.S.F.) | 1 part |

A numeral in the parentheses of a polyethylene glycol mono behenyl ether denotes a number of repeating ethylene oxide units.

COMPARATIVE EXAMPLE 1

A thermal transfer recording medium was prepared in a manner same as that of Example 1, except that aqueous emulsion (I) in Example 1 for forming the first heat softening layer was replaced with aqueous emulsion (I-1C), whose composition specified below, for forming a heat softening layer.

Aqueous emulsion (I-1C) for first heat softening layer

| | |
|---|---|
| Aqueous paraffin wax emulsion | 95 parts |
| Aqueous ethylene-vinyl acetate copolymer emulsion | 5 parts |

COMPARATIVE EXAMPLE 2

A thermal transfer recording medium was prepared in a manner same as that of Example 1, except that aqueous emulsion (I) in Example 1 for forming the second heat softening layer was replaced with aqueous emulsion (I-2C), whose composition specified below, for forming a heat softening layer.

Aqueous emulsion (I-2C) for first heat softening layer

| | |
|---|---|
| Aqueous acrylic emulsion | 45 parts |
| Aqueous paraffin wax emulsion | 29 parts |
| Aqueous carbon black dispersion | 25 parts |
| FT-248 (fluorinated surfactant, make of B.A.S.F.) | 1 part |

EXAMPLE 2

A thermal transfer recording medium of the invention was prepared in a manner identical with that of Example 1, except that aqueous emulsion (I) for the first heat softening layer was replaced with aqueous emulsion (II), whose composition specified below, for the first heat softening layer; that aqueous emulsion (I) for the second heat softening layer was replaced with aqueous emulsion (II), whose composition specified below, for the second heat softening layer; and that the dry thickness of the first heat softening layer was 3 μm, and the dry thickness of the second heat softening layer was 2 μm.

Aqueous emulsion (II) for first heat softening layer

| | |
|---|---|
| Aqueous paraffin wax emulsion | 35 parts |
| Aqueous acrylic emulsion | 20 parts |
| Aqueous polyoxyethylene (100) emulsion | 10 parts |

-continued

| | |
|---|---|
| Aqueous carbon black dispersion | 15 parts |

Aqueous emulsion (II) for second heat softening layer

| | |
|---|---|
| Aqueous ethylene-vinyl acetate copolymer emulsion | 25 parts |
| Aqueous acrylic emulsion | 25 parts |
| Aqueous polyoxyethylene (100) emulsion | 15 parts |
| Aqueous carbon black dispersion | 20 parts |
| Aqueous paraffin wax emulsion | 24 parts |
| FT-248 (fluorinated surfactant, make of B.A.S.F.) | 1 part |

COMPARATIVE EXAMPLE 3

A thermal transfer recording medium was prepared in a manner same as that of Example 2, except that aqueous emulsion (II) in Example 2 for forming the first heat softening layer was replaced with aqueous emulsion (II-1C), whose composition specified below, for forming a heat softening layer.

Aqueous emulsion (I-2C) for first heat softening layer

| | |
|---|---|
| Aqueous paraffin wax emulsion | 45 parts |
| Aqueous acrylic emulsion | 20 parts |
| Aqueous carbon black dispersion | 15 parts |

COMPARATIVE EXAMPLE 4

A thermal transfer recording medium was prepared in a manner same as that of Example 2, except that aqueous emulsion (II) in Example 2 for forming the second heat softening layer was replaced with aqueous emulsion (II-2C), whose composition specified below, for forming a heat softening layer.

Aqueous emulsion (II-2C) for second heat softening layer

| | |
|---|---|
| Aqueous ethylene-vinyl acetate copolymer emulsion | 15 parts |
| Aqueous acrylic emulsion | 25 parts |
| Aqueous carbon black dispersion | 20 parts |
| Aqueous paraffin wax emulsion | 39 parts |
| FT-248 (fluorinated surfactant, make of B.A.S.F.) | 1 part |

Evaluation

Print quality test

The thermal transfer recording media obtained in these examples and comparative examples were independently loaded into a commercially available high-speed printer (24 dot type; serial heads; pressure on platen, 200 g/head; energy applied, 25 mJ/head) and subjected to a transferring (printing) operation of alphabetical letters at a varied printing speed in Table 1 with a varied transferee medium in Table 1, thereby print quality was evaluated.

The evaluation results are listed in Table 1.

The meanings of symbols in Table 1 are as follows:

| Symbol | Print quality |
|---|---|
| E | Letters reproduced are excellent. |
| G | Letters reproduced are good. |
| P | Letters reproduced are poor. |
| B | Letters reproduced are bad not applicable to practical use. |

TABLE 1

| Paper types | Lancaster paper | Copy paper | Neenah bond paper |
|---|---|---|---|
| Bekk smoothness | 2" | 40" | 10" |
| Printing speed | 50 cps | 100 cps | 70 cps*2 |
| Example 1 | E | E | E |
| Comparative 1 | P | P | B |
| Comparative 2 | B | B | B |
| Example 2 | E | E | G*1 |
| Comparative 3 | P | B | B |
| Comparative 4 | P | B | B |

Note *1: Minor scumming occurred
Note *2: Characters per second

EFFECT OF THE INVENTION

The thermal transfer recording medium of the present invention has a laminated heat softening layer, wherein both a first heat softening layer formed adjacent to a support, and a second heat softening layer independently contain a polyoxyethylene compound. The polyoxyethylene compound in the first heat softening layer serves as a supercooling substance, while the polyoxyethylene compound in the second heat softening layer serves not only as a supercooling substance but also as a carrier substance that transports the constituents of this layer such as a colorant. Accordingly, the thermal transfer recording medium of the invention is capable of significantly high print quality with a transferee medium of poor surface smoothness at a high speed, and such high quality at a high speed has not been achieved by a conventional thermal thermal transfer recording media.

The print quality of the present recording medium can be further improved by adjusting the content rates of the heat-fusible substance and the thermoplastic resin in the first and second heat softening layers, and by adjusting the content rates of polyoxyethylene compounds in the first and second heat softening layers.

What is claimed is:

1. A thermal transfer recording medium comprising a support having thereon a first heat softening layer and a second heat softening layer in this order, wherein said first and second heat softening layers contain a polyethylene glycol derivative having an ester linkage or an ether linkage, and at least one of said layers contains a colorant.

2. The thermal transfer recording medium of claim 1, wherein said polyethylene glycol derivative has a melting point within the range of 30° to 120° C.

3. The thermal transfer recording medium of claim 2, wherein said polyethylene glycol derivative has a melting point within the range of 40° to 100° C.

4. The thermal transfer recording medium of claim 1, wherein the content of said polyethylene glycol derivative content in said first heat softening layer and said second softening layers are not more than 15%, and not more than 25% by weight, respectively.

5. The thermal transfer recording medium of claim 4, wherein the content of said polyethylene glycol derivative in said first heat softening layer and said second heat softening layer are within the range of from 1 to 10%, and from 5 to 20% by weight, respectively.

6. The thermal transfer recording medium of claim 1, wherein said polyethylene glycol derivative is polyethyleneglycol monobehenylether.

7. The thermal transfer recording medium of claim 1, wherein said polyethylene glycol derivative is polyethyleneglycol distearate.

8. The thermal transfer recording medium of claim 1, wherein said first and second heat softening layers contain a thermoplastic resin and a heat fusible substance selected from the group consisting of vegetable waxes, animal waxes, petroleum waxes, mineral waxes, higher fatty acids, higher alcohols, higher fatty acid esters, amides and higher amines.

9. The thermal transfer recording medium of claim 8, wherein the content of said heat fusible substance is higher than that of said thermoplastic resin in said first heat softening layer, and the content of said thermoplastic resin is higher than that of said heat fusible substance in said second heat softening layer.

10. The thermal transfer recording medium of claim 8, wherein a blending ratio by weight of said heat fusible substance and said thermoplastic resin in said first heat softening layer is within the range of from 99:1 to 55:45, and a blending ratio by weight of said heat fusible substance and said thermoplastic resin in said second heat softening layer is within the rang of from 10:90 to 45:55.

11. The thermal transfer recording medium of claim 10, wherein a blending ratio by weight of said heat fusible substance and said thermoplastic resin in said first heat softening layer is within the range of from 90:10 to 60:40, and a blending ratio by weight of said heat fusible substance and said thermoplastic resin in said second heat softening layer is within the range of from 15:85 to 40:60.

12. The thermal transfer recording medium of claim 1, wherein said first and second heat softening layers each are applied to said support by applying aqueous emulsion containing constituents of said layers, respectively.

13. The thermal transfer recording medium of claim 12, wherein said second heat softening layer contain a fluorinated surfactant.

14. The thermal transfer recording medium of claim 13, wherein said fluorinated surfactant content of said second heat softening layer is within the range of from 0.05 to 3% by weight.

15. The thermal transfer recording medium of claim 12, wherein dry thicknesses of said first and second heat softening layers each are within the range of from 1 μm to 4 μm, respectively.

16. The thermal transfer recording medium of claim 15, wherein the dry thickness of said first heat softening layer is 1.1 to 1.8 times as large as that of said second heat softening layer.

17. The thermal transfer recording medium of claim 1, wherein said polyethylene glycol derivative is a polyethylene glycol mono- or di-esterified with a fatty acid having 10 to 50 carbon atoms.

18. The thermal transfer recording medium of claim 1, wherein said polyethylene glycol derivative is a polyethylene glycol mono-etherified glycol with an alkyl group or an alkylaryl group having 18 to 6 carbon atoms.

19. The thermal transfer recording medium of claim 1, wherein said polyethylene glycol derivative is a polyethylene glycol etherified on one —OH group thereof and etherified or esterified on the other —OH group thereof.

20. The thermal transfer recording medium of claim 1, wherein said polyethylene glycol derivative is a polyethylene glycol mono- or di-etherified with a polyvalent alcohol.

21. The thermal transfer recording medium of claim 1, wherein said polyethylene glycol derivative is polyethylene glycol monobehenate; polyethylene glycol monopalmitate; polyethylene glycol dibehenate or polyethylene glycol laurinate.

22. The thermal transfer recording medium of claim 1, wherein said polyethylene glycol derivative is monobehenate of polyethylene glycol mono-P-nonylphenyl ether; monostearate of polyethylene glycol monobehenyl ether; polyethylene glycol dibehenyl ether; or polyethylene glycol monooleyl ether monobehenyl ether.

23. The thermal transfer recording medium of claim 1 wherein said polyethylene glycol derivative is polyethylene glycol mono-P-nonylphenyl ether; polyethylene glycol monocetyl ether; or polyethylene glycol monooleyl ether.

* * * * *